US005983903A

United States Patent [19]

Nanba et al.

[11] Patent Number: 5,983,903

[45] Date of Patent: Nov. 16, 1999

[54] HAIR IRON

[75] Inventors: Yoshiyuki Nanba; Kazuyasu Ikadai; Hisashi Kitamura; Eiji Tsuji; Hiroyuki Tagishi, all of Shiga, Japan

[73] Assignee: Matsushita Electric Works, Ltd., Osaka, Japan

[21] Appl. No.: 08/928,717

[22] Filed: Sep. 12, 1997

[30] Foreign Application Priority Data

Oct. 15, 1996 [JP] Japan ..... 8-272624

[51] Int. Cl.[6] ..... A45D 6/02

[52] U.S. Cl. ..... 132/228; 132/243

[58] Field of Search ..... 132/227, 228, 132/229, 232, 234, 236, 240, 241, 243, 268, 272; 219/222, 225, 226

[56] References Cited

U.S. PATENT DOCUMENTS

| | | | |
|---|---|---|---|
| 1,377,655 | 5/1921 | Begas | 132/229 |
| 1,999,898 | 4/1935 | Fitzgerald | 132/232 |
| 3,660,634 | 5/1972 | Scott | 219/222 |
| 3,768,491 | 10/1973 | Barradas | 219/222 |
| 3,937,230 | 2/1976 | Kenny | 132/232 |
| 4,426,567 | 1/1984 | Gugliotti | 132/323 |
| 4,464,562 | 8/1984 | Takimae | 132/232 |
| 4,866,249 | 9/1989 | Howard | 132/229 |
| 4,939,340 | 7/1990 | Brill | 132/229 |
| 4,953,574 | 9/1990 | Tsuji et al. | 132/232 |
| 5,660,191 | 8/1997 | Bontoux et al. | 132/228 |
| 5,673,710 | 10/1997 | Schaefer et al. | 132/229 |
| 5,810,026 | 9/1998 | Sham | 132/236 |
| 5,868,146 | 2/1999 | Henninger et al. | 132/232 |

FOREIGN PATENT DOCUMENTS

| | | | |
|---|---|---|---|
| 330940 | 6/1930 | United Kingdom | 132/236 |

*Primary Examiner*—Jeffrey A. Smith
*Assistant Examiner*—Eduardo C. Robert
*Attorney, Agent, or Firm*—Armstrong, Westerman Hattori, McLeland & Naughton

[57] ABSTRACT

A hair iron is provided which includes a hair curling body having an outer peripheral surface on which hairs are wound, a clip for holding the hairs between the inner surface of the clip and the outer peripheral surface of the hair curling body and a heater for heating the hair curling body. The clip is made of low heat conductive materials. A plurality of rib-shaped guards, which extend in a circumferential direction of the hair curling body, are provided at least on an area of the outer peripheral surface of the hair curling body other than the area facing the clip. The guards are made of low heat conductive materials. The guards are disposed at certain spaced intervals in an axial direction of the hair curling body. The guards are connected by connecting rods which are buried in the hair curling body such that upper surfaces of the guards are positioned so as to be at the same level as or below the outer peripheral surface of the hair curling body so that the connecting rods never cause hairs to be displaced from the outer peripheral surface of the hair curling body and prevent hairs from clinging to the rods.

11 Claims, 14 Drawing Sheets

HAIR IRON

BACKGROUND OF THE INVENTION

1. Field of the Invention

This invention relates to a hair iron for curling hairs.

2. Description of the Related Arts

Conventionally, this kind of hair iron comprises a hair curling body having an outer peripheral surface on which hairs are wound, a clip for holding the hairs between the clip and the outer peripheral surface of the hair curling body and a heater for heating the hair curling body. In using the hair iron, it is likely that the user will feel heat, and there is a slight chance that the user might be burned, if the user were to allow the heated hair curling body to come into contact with the skin.

To avoid the risk of getting burned, Japanese unexamined Utility Model Publication No. Sho 52-74868 suggests that a plurality of rib-shaped guards extending in a circumferential direction of the hair curling body are formed on the outer peripheral surface of the hair curling body. The guards are connected by a plurality of connecting rods and are disposed at certain intervals in an axial direction of the hair curling body. The guards prevent the outer peripheral surface of the hair curling body from coming into direct contact with the skin of the user of the hair iron. The guards are formed so as to be rib-shaped members which extend in the circumferential direction of the hair curling body so as not to disturb the hairs, when the hairs are wound around the hair curling body of the hair iron.

In the hair iron disclosed in the above-mentioned publication, there have been the following drawbacks. The connecting rods connecting the guards are positioned above an outer peripheral surface of the hair curling body. Thus, when hairs are wound around the hair curling body to curl the hairs, the presence of the connecting rods causes the hairs not to come into direct contact with the outer peripheral surface of the hair curling body. As a result, heat is not sufficiently transferred from the hair curling body to the hairs to be curled, resulting in insufficient hair curl and leaving marks on the hairs. Furthermore, when the curled hairs wound around the hair curling body are removed from being curled around the hair curling body, the hairs tend to cling to the connecting rods, resulting in uneasy detachment of the hairs from the hair curling body.

SUMMARY OF THE INVENTION

An object of the present invention is to provide a hair iron which prevents the user from feeling too much heat on the user's skin, which prevents the user from getting burned and which enables hairs to be curled smoothly and certainly.

According to the present invention, a hair iron comprises a hair curling body having an outer peripheral surface on which hairs are wound, a clip for holding the hairs between the clip and the outer peripheral surface of the hair curling body and a heater for heating the hair curling body. The clip is made of low heat conductive materials. A plurality of rib-shaped guards which extend in a circumferential direction of the hair curling body are provided at least on an area of the outer peripheral surface of the hair curling body other than an area facing the clip. The rib-shaped guards are made of low heat conductive materials. The rib-shaped guards are disposed at certain intervals in an axial direction of the hair curling body and are connected by connecting rods which are buried in the hair curling body such that upper surfaces of the guards are positioned so as to be at the same level as or below the outer peripheral surface of the hair curling body.

The guards keep a certain distance between the surface of the hair curling body and the user's skin. Because the connecting rods connecting the guards are positioned in the hair curling body such that upper surfaces of the guards are positioned so as to be at the same level as or below the outer peripheral surface of the hair curling body, the connecting rods never cause hairs from being displaced from the surface of the hair curling body and hairs never cling to the connecting rods.

If the connecting rods are disposed in dovetail grooves, wherein each dovetail groove is formed in the outer peripheral surface of the hair curling body, then the connecting rods are prevented from being projected radially outwardly from the outer peripheral surface of the hair curling body.

The guards may also be provided in an area of the hair iron which faces the clip.

The guards preferably have a height of about 2 mm, a width of about 1 mm and are arranged on the outer peripheral surface of the hair curling body at intervals of 5–6 mm. The presence of the guards in the preferred dimension and spacing minimizes the decrease in the surface area of the hair curling body, while preventing contact between the user's skin and the outer peripheral surface of the hair curling body.

Small protrusions may be provided on the outer peripheral edges of the guards instead of raising the entire height of the guards. Thus, the small protrusions allow a certain distance between the user's skin and the outer peripheral surface of the hair curling body to prevent the user from being burned, without causing any obstacles when hairs are wound around the hair curling body and/or detached therefrom.

The guards may be spiral-shaped members formed on the outer peripheral surface of the hair curling body. This enables the hairs to be curled into a curly hair style because the hairs can be wound continuously. Further, in the case where the guards are spiral-shaped, if the length of the clip is limited to only a part of the entire length of the axial direction of the hair curling body, the operations of winding hairs around the hair curling body and fixing hairs to the outer peripheral surface of the hair curling body via the clip can be performed easily.

In the case where the guards are formed only on an area of the hair curling body not facing the clip, a certain space may preferably be formed between the edges of the guards and the lateral edge of the clip. This prevents from the hairs from clinging to a boundary portion between the guards and the clip.

The guards may be detachably attached to the hair curling body. This enables the detachment of the guards, when the guards are unnecessary, and also allows for the exchange of the guards for different ones.

A hair slip preventing device may be provided to an area of the hair curling body facing the clip so that the hairs wound around the hair curling body can be more surely held.

A stand, which outwardly protrudes beyond the guards, may be provided on the hair iron. This prevents the guards from being deformed by the weight of the hair iron and also prevents the guards from being damaged by the heat of the hair curling body when the hair iron is placed on a desk or other flat surface and the guards come into contact with the desk or other flat surface.

Other objects and advantages of the present invention will become apparent from the description of the preferred embodiments, which may be modified in any manner without departing from the spirit and scope of the invention.

BRIEF DESCRIPTION OF THE DRAWING FIGURES

DETAILED DESCRIPTION OF THE PREFERRED EMBODIMENTS

Preferred embodiments of a hair iron, according to the present invention, will now be described in detailed, with reference to the accompanying drawings.

Figure 2:
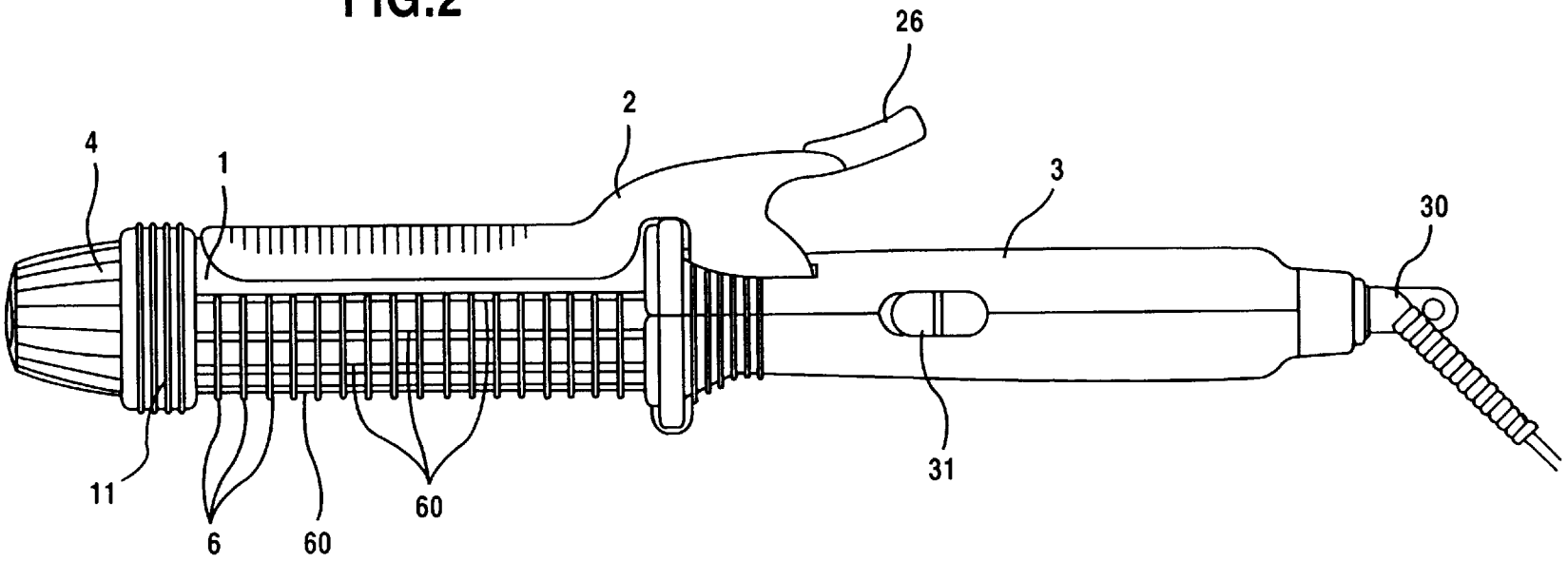
FIG. 2 is a front view of the hair iron of FIG. 1.
Figure 3:
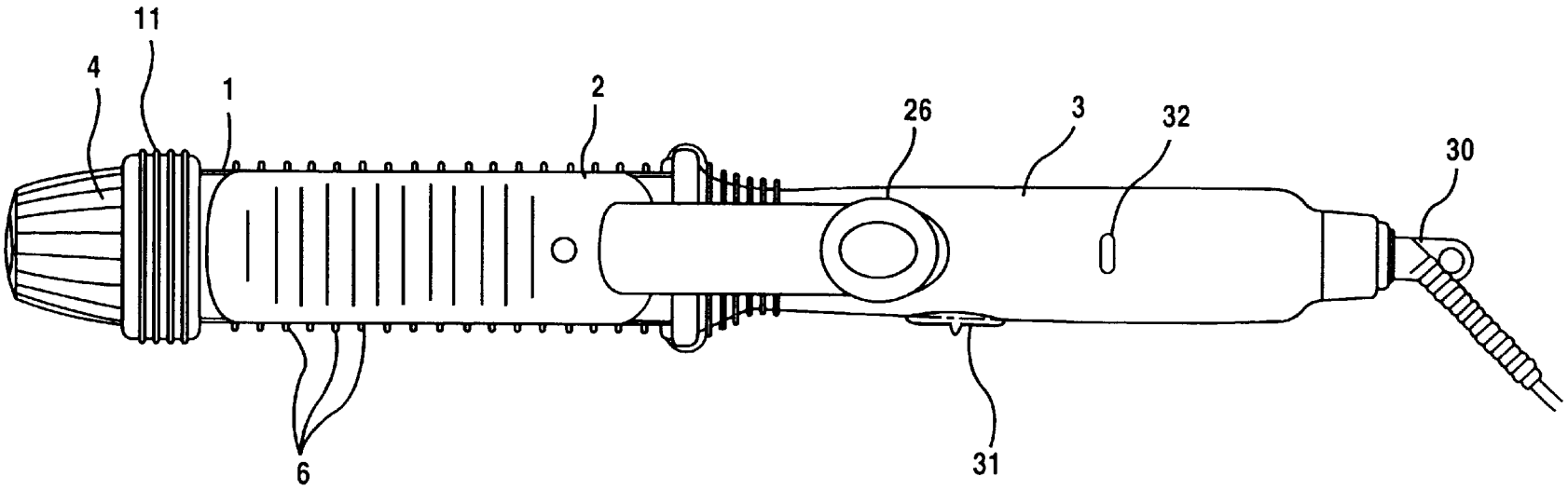
FIG. 3 is a top view of the hair iron of FIG. 1.
Figure 4:
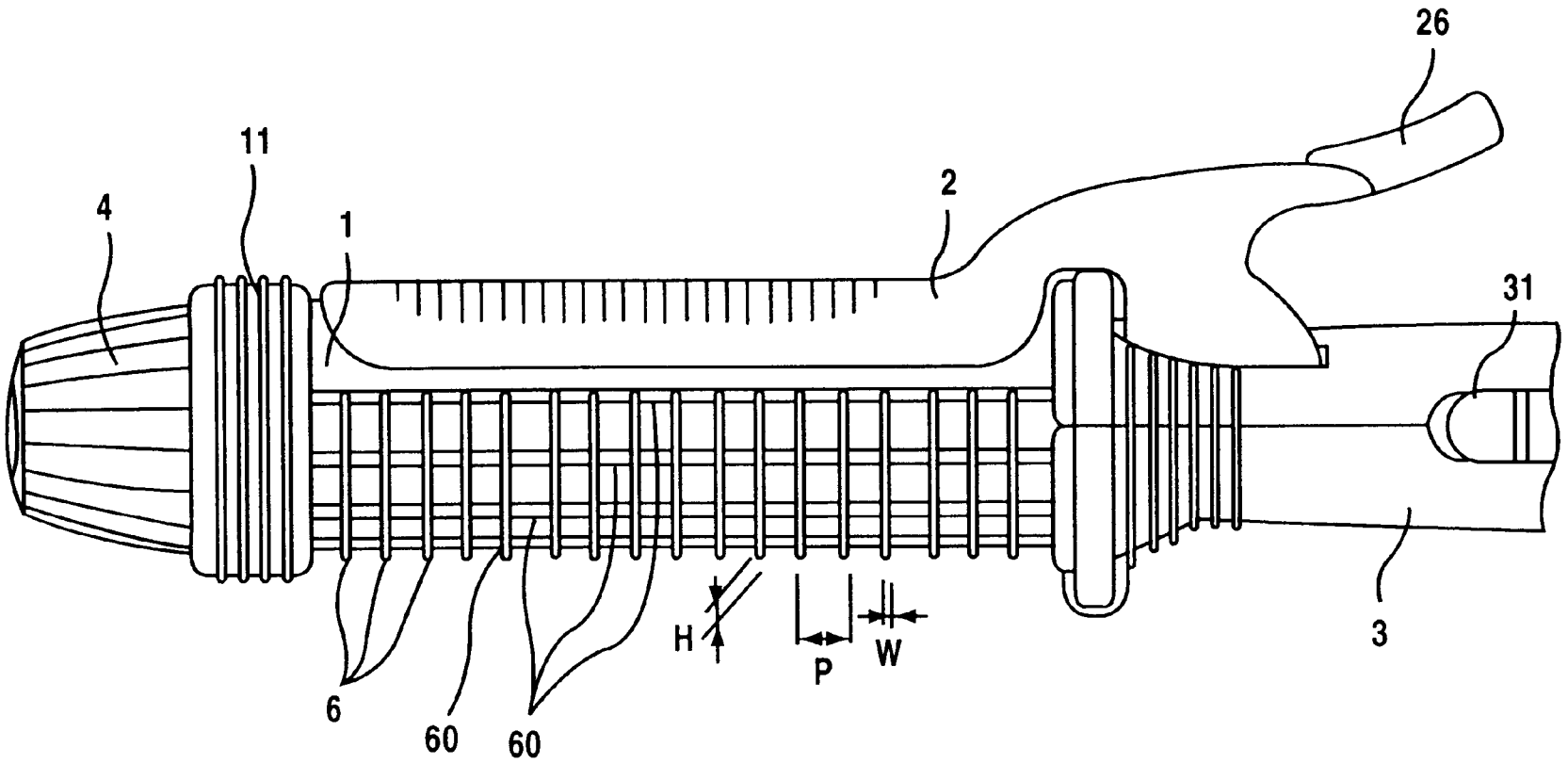
FIG. 4 is an enlarged front view of the hair iron of FIG. 1.
Figure 5:
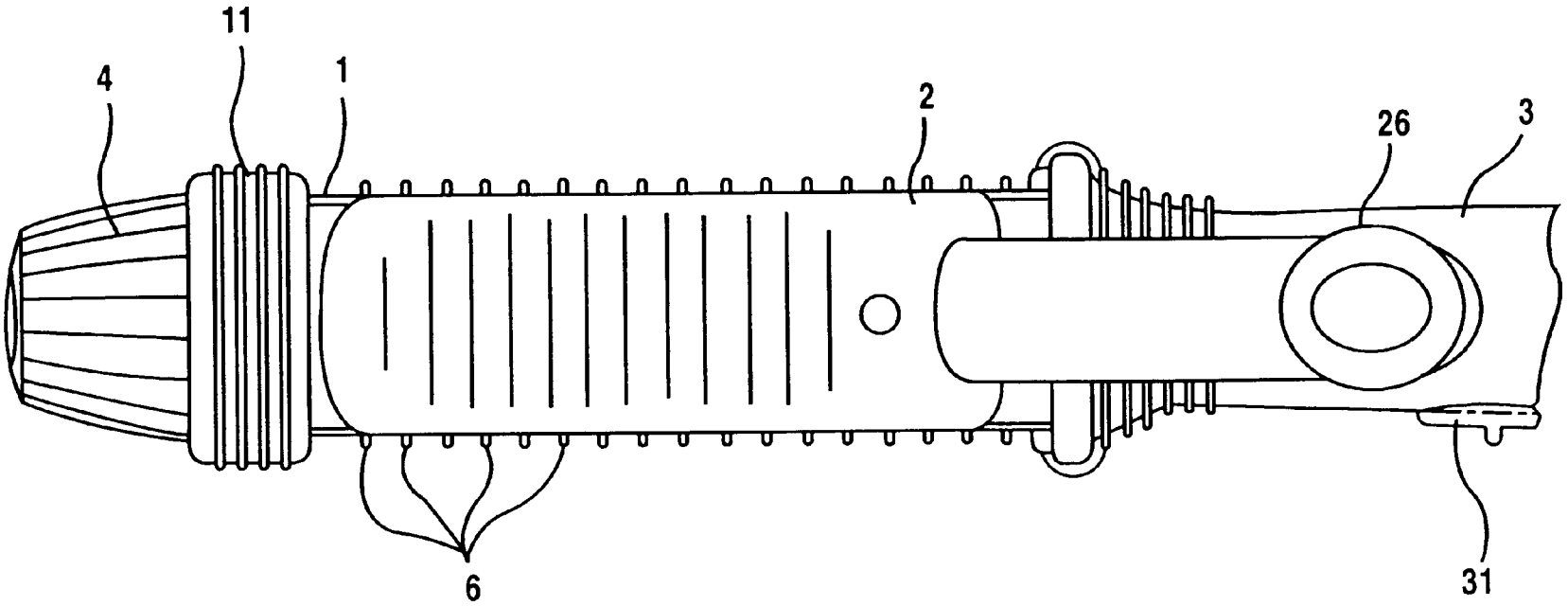
FIG. 5 is an enlarged top view of the hair iron of FIG. 1.

As shown in FIGS. 2 and 3, the hair iron is a steam generating type of hair iron which includes a stick-shaped hair curling body 1 protruding from a leading edge of a grip portion 3 and a clip 2 pivoted to the leading edge portion of the grip portion 3 which contacts the outer peripheral surface of the hair curling body 1 by means of spring force. In the hair curling body 1, a heater block 5 is provided for heating the hair curling body 1 and water is supplied from a water tank 4 attached to the leading edge of the hair curling body 1 to generate steam. The other end of the grip portion 3 is provided with a power supply cord 30 for providing electric power to the heater block 5. A switch 31 is for controlling electricity to the heater block 5 and a power lamp 32 is lit when the electricity is turned on.

Figure 1:
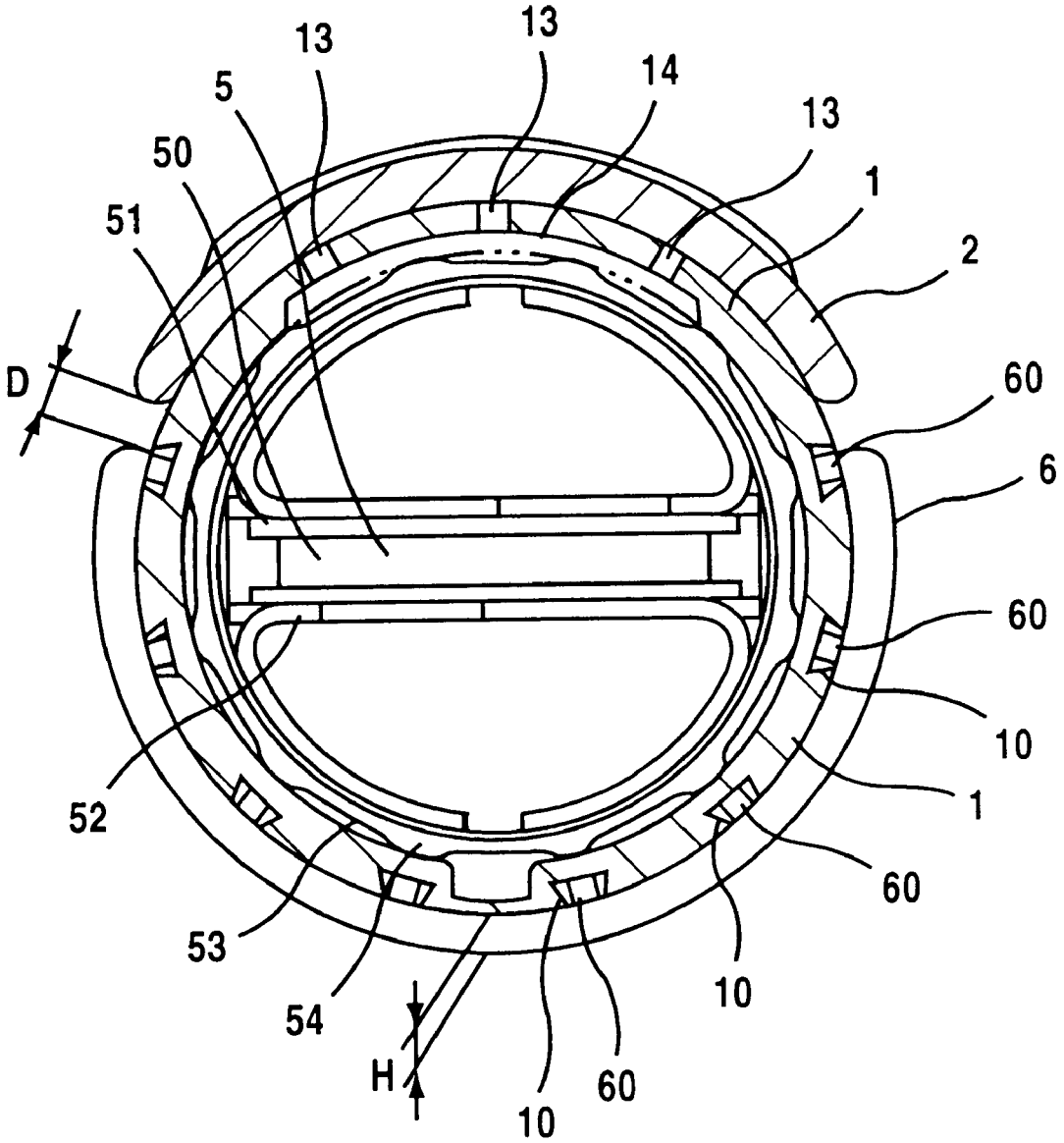
FIG. 1 is a cross-sectional view of a first embodiment of a hair iron according to the present invention.
Figure 6:
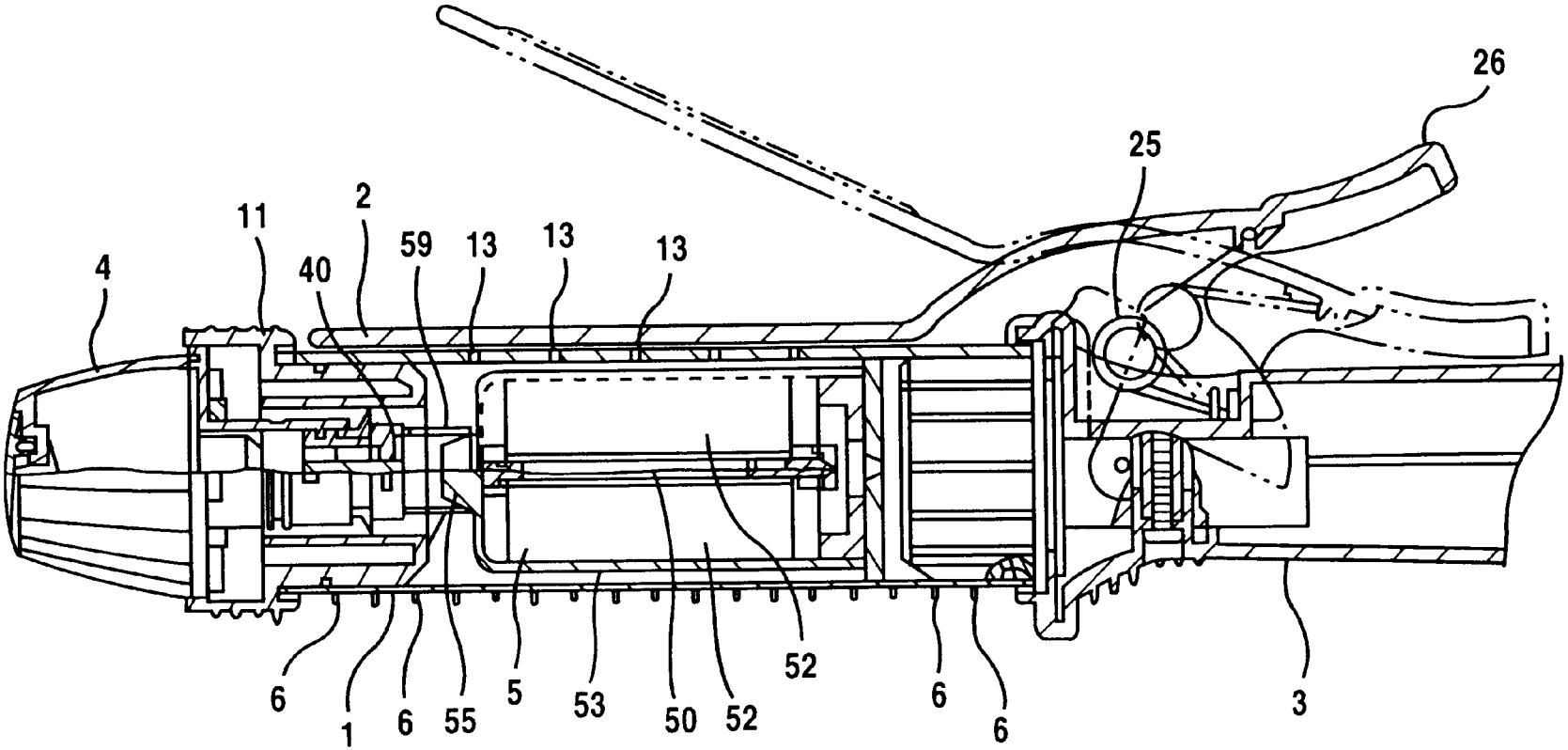
FIG. 6 is partial vertical cross-sectional view of the hair iron of FIG. 1.

As shown in FIGS. 1 and 6, the heater block 5, which is disposed in the hair curling body 1, includes a PTC (positive temperature coefficient) heater 50, aluminous plates 51, 51 and semicircular heat sinks 52, 52. Each of the heat sinks 51, 51 are disposed on one side of the heater 50. Thus, the heater block 5, heater 50, aluminous plates 51, 51 and heat sinks 52, 52, once assembled, are fitted in a cylindrical heater pipe 53 having a bottom end. A plurality of protrusions 54 are provided on the outer peripheral surface of the heater pipe 53 and extend in the axial direction of the heater pipe 53 at certain circumferential intervals. At the central portion of the closed leading end of the heater pipe 53, a convex portion 55 is provided. When the heater block 5 is inserted in the hair curling body 1, the heater block 5 is contacted by the inner surface of the hair curling body 1 at the outer peripheral surface of the protrusion 54.

The hair curling body 1 is made of synthetic resin or metal having high thermal conductivity. The outer peripheral surface of the hair curling body 1 has a plurality of dovetail grooves 10 therein, except for that portion of the hair curling body 1 which faces the clip 2. The dovetail grooves 10 extend in the axial direction of the hair curling body 1 and are provided at certain spaced intervals in the circumferential direction of the hair curling body 1. On the inner surface of the hair curling body 1 facing the clip 2, a concave portion is formed to act as a steam gathering space 14 between the outer peripheral surface of the heater pipe 53 and the inner surface of the hair curling body 1. A plurality of steam holes 13 are formed as penetrating holes for spouting out steam to aid in curling hairs. The steam gathering space 14 communicates with the outer peripheral surface of the hair curling body 1 via the steam holes 13. The hair curling body 1, including the dovetail grooves 10 and the concave portion, may be formed by an extrusion process.

Figure 7:
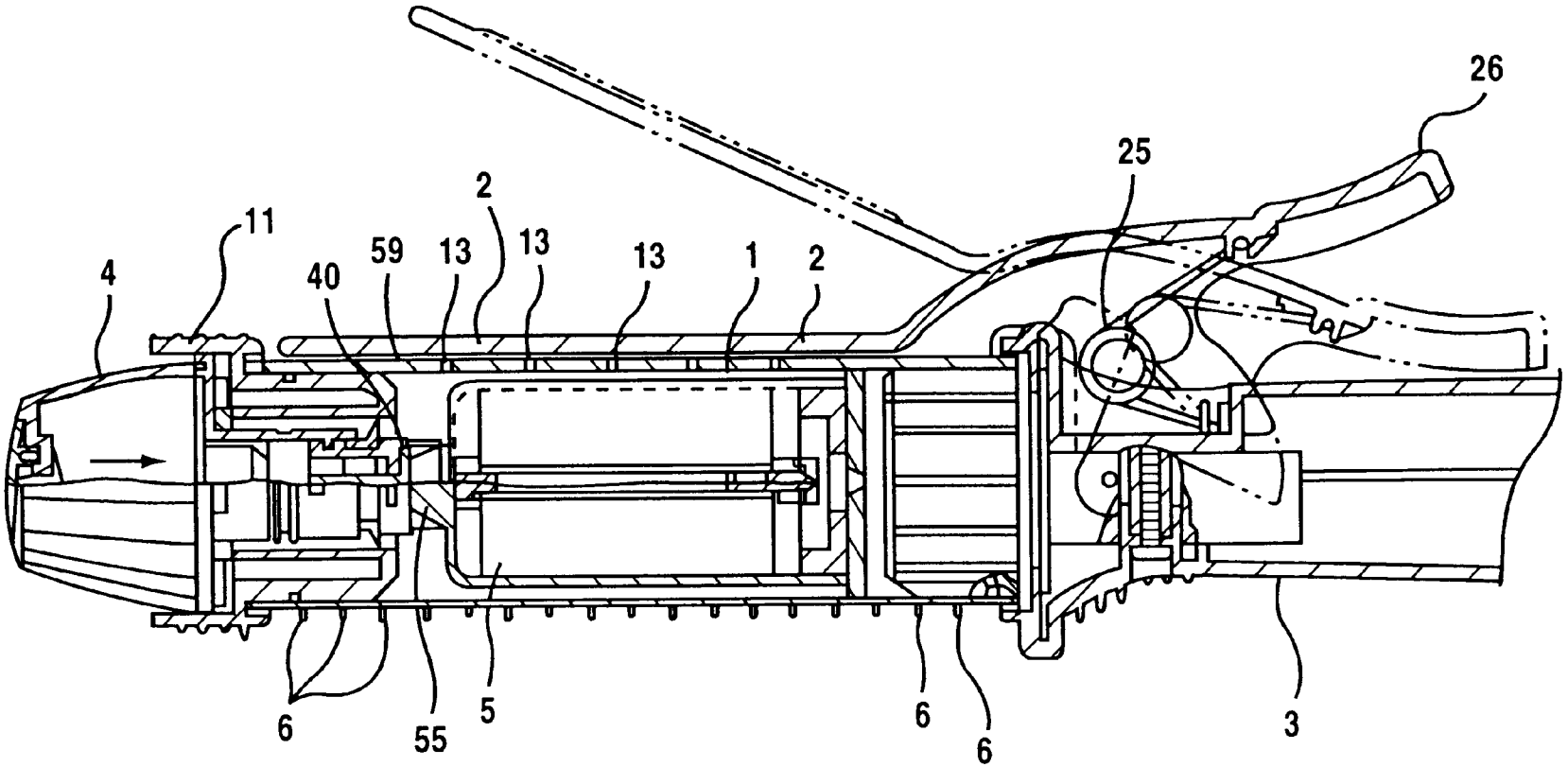
FIG. 7 is partial vertical cross-sectional view of the hair iron of FIG. 1, being shown when steam is generated.

A cylindrical body 11 is attached to the leading end portion of the hair curling body 1. A water tank 4 is slidably held in the cylindrical body 11 and detachably attached to the cylindrical body 11. The water tank 4 has an inserting portion to be inserted into the hair curling body 1. On a leading edge of the inserting portion a water suction member 40 is provided. The water suction member 40 is made of felt or similar which contacts the water filled in the water tank 4. The leading edge face of the water suction member 40 is usually kept out of contact with the heater block 5 by means of the spring force of a coil spring 59. The coil spring 59 is disposed between the water suction member 40 and the leading edge of the heater block 5. As shown in FIG. 7, when the water tank 4 is pushed toward the heater block 5 against the spring force of the coil spring 59, the water suction member 40 comes into contact with the leading edge of the convex portion 55 of the heater block 5. Therefore, if the water tank 4 is filled with water and is pushed toward the heater block 5 so that the water suction member 40 comes into contact with the convex portion 55 when the heater block 5 is heated by turning on the electricity, steam will be generated by the evaporation of water contained in the water suction member 40. Then, the steam will spout outwardly from the steam holes 13 from the steam gathering space 14.

The clip 2 includes an arc-shaped member having a cross-section which fits the outer peripheral surface of the hair curling body 1 and is preferably made of low heat conductive materials such as either glass-fiber reinforced PBT (polybutylene telephthalate) or nylon. The clip 2 preferably has a width covering approximately one-third of the outer circumference of the hair curling body 1. As clearly shown in FIG. 6, the clip 2 is rotatably connected to the grip portion 3 with one end of a coil spring 25 being pivoted to the grip portion 3 and the other end thereof being connected to the clip 2. The clip 2 is urged by the coil spring 25 so as to come into contact with the outer peripheral surface of the hair curling body 1. Pressing a lever portion 26 of the clip 2 toward the grip portion 3 rotates the clip 2 so as to detach the clip 2 from the outer peripheral surface of the hair curling body 2.

The guards 6 attached on the outer peripheral surface of the hair curling body 1 will be explained as follows. Each of the guards 6 is made of low heat conductive materials such as PBT or nylon. In the first embodiment shown in FIGS. 1 to 7, a plurality of guards 6 are disposed on an area of the hair curling body 1 not facing the clip 2 at certain intervals in the axial direction of the hair curling body 1. Each guard 6 is an arc-shaped member which has a width W of about 1 mm and a height H of about 2 mm from the outer peripheral surface of the hair curling body 1. The guards 6 are provided on the hair curling body 1 at 5 to 6 mm intervals. A certain distance D is provided between the edges of the guards 6 and the lateral edge of the clip 2. Both the edges of the guards 6 and the lateral edges of the clip 2 are formed to be of a round shape.

Figure 11:
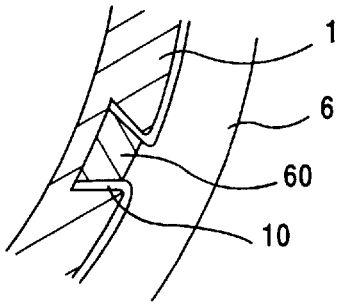
FIG. 11 is an enlarged partial cross-sectional view of a third embodiment of the hair iron of the present invention showing the hair curling body and the guards.

Each guard 6 is connected by a plurality of connecting rods 60 extending in the axial direction of the hair curling body 1. Each connecting rod 60 is buried in the hair curling body 1 by fitting within one of the dovetail grooves 10 formed in the outer peripheral surface of the hair curling body 1. Thus, the upper surfaces of the guards 6 are positioned so as to be at the same level as or below the outer peripheral surface of the hair curling body 1. In the first embodiment, in order to detachably attach the guards 6 to the hair curling body 1, the width of each guard 60 is set to approximately the same as or smaller than the opening width of the dovetail groove 10. This enables the detachment of the guards 6 from the hair curling body 1 by spreading the guards 6 apart, wherein the guards 6 have enough elasticity to pull out the connecting rods 60 from the dovetail grooves 10. When the guards 6 are attached to the hair curling body 1, the connecting rods 60 are not pulled out from the dovetail grooves 10 by the elasticity of the guards 6. However, as shown in FIG. 11, the cross-section of the connecting rod 60 may be formed corresponding to the cross-section of the dovetail groove 10 so that the guards 6 cannot be attached nor detached. In the third embodiment shown in FIG. 11, attaching the guards 60 to the hair curling body 1 can be done by inserting the connecting rods 60 into the dovetail grooves 10 from the openings in the outer peripheral surface of the hair curling body 1, when the cylindrical body 11 is not yet attached to the hair curling body 1.

In the hair iron having thus formed guards 6, curling hairs is performed by winding hairs around the hair curling body 1 and holding the hairs to the outer peripheral surface of the hair curling body 1 by means of the clip 2, to thereby heat the hairs and also steam the hairs, if necessary. The rib-shaped guards 6 disposed at certain intervals in the axial direction of the hair curling body 1 prevents the surface of the hair curling body 1, which has been heated to about 135±10° C., from coming into contact with the user's skin.

The steam holes 13 for spouting out steam are provided only to the portion of the hair curling body 1 covered by the clip 2. Therefore, direct contact of steam with the user's skin is prevented, so that the user does not feel the heat or get burned. Further, the steam holes 13 are provided near a central portion in the width direction of the clip 2. Therefore, the amount of steam, leaked from between the hair curling body 1 and the clip 2, is limited. Even if some steam is leaked, the temperature of the leaked steam has been decreased. As a result, there is no problem of the user feeling the heat from the steam which has leaked out from between the hair curling body 1 and the clip 2. Because steam spouted out from the steam holes 13 is held in the small space formed between the hair curling body 1 and the clip 2, the hairs pinched between the outer peripheral surface of the hair curling body 1 and the clip 2 can effectively be exposed to steam. Because the clip 2 is formed of low heat conductive materials, sudden heat reduction by means of the clip 2 absorbing the heat does not occur and thus, sufficient steam effects to curl the hairs can be obtained.

Since hairs are wound around the hair curling body 1 between the guards 6, the guards 6 do not become obstacles when the hairs are heated. Because the connecting rods 60 connecting the guards 60 do not protrude from the outer peripheral surface of the hair curling body 1, the presence of the connecting rods 60 never prevents the hairs from coming into contact with the outer peripheral surface of the hair curling body 1. Therefore, heat of the hair curling body 1 is surely supplied to the hairs and the connecting rods 60 will not leave marks on the hairs. After the hairs are curled, when the curled hairs wound around the hair curling body 1 are to be removed from the hair curling body 1, the hairs do not cling to the connecting rods 60.

If the width W, height H and pitch P of the guards 6 are set as mentioned above, the guards 6 can be strengthened, while a decrease in the surface area of the hair curling body 1 by the presence of the guards 6 is limited to a minimum. Further, the contact between the outer peripheral surface of the hair curling body 1 and the user's skin can surely be prevented. Because a certain space is formed between the lateral edges of the clip 2 and the edges of the guards 6 and these edges are formed to be round, unexpected curling of hairs caused by pinching hairs between the clip 2 and the guards 6 does not occur, and further winding hairs around the hair curling body 1 and unwinding hairs from around the hair curling body 1 can be performed smoothly.

Figure 8:
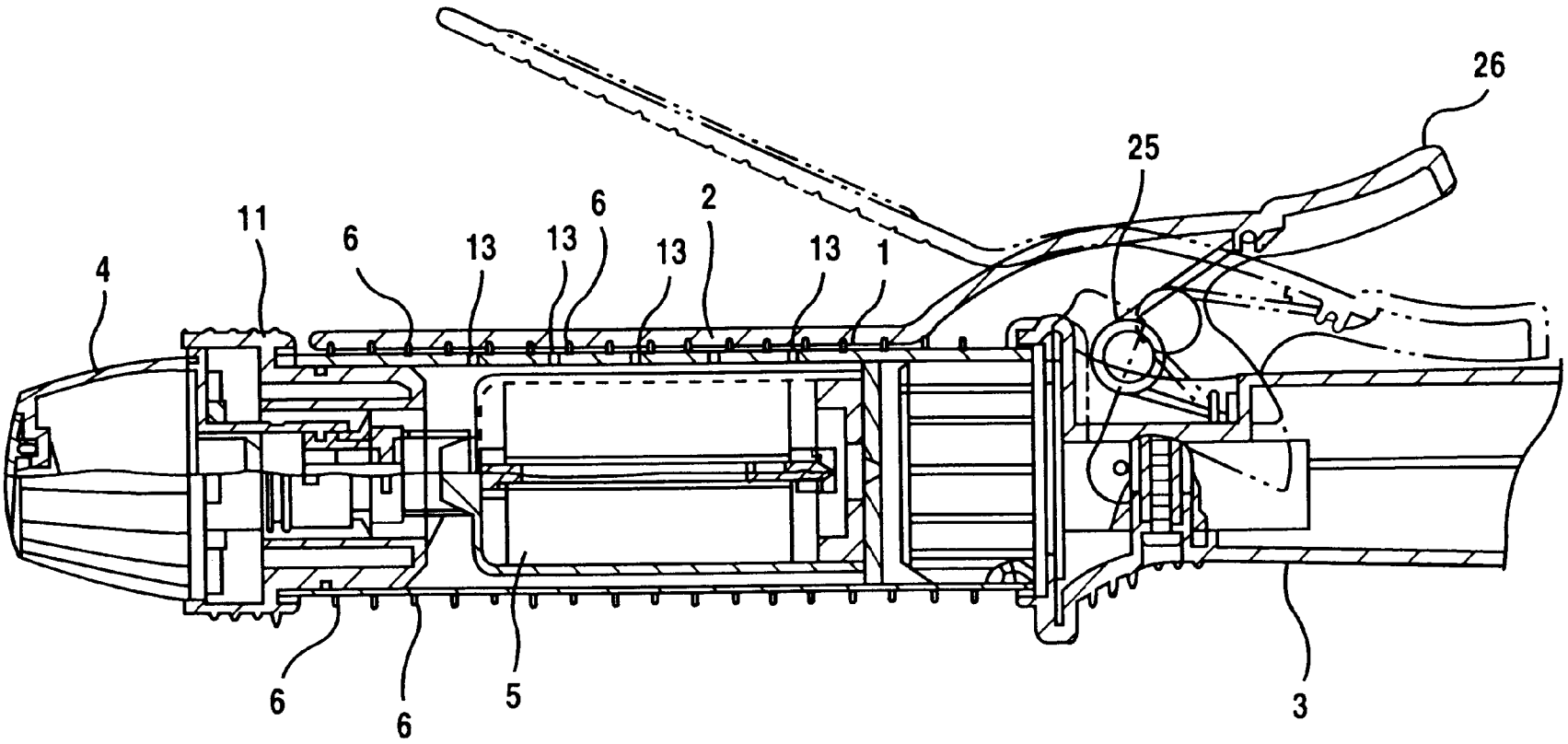
FIG. 8 is a partial cross-sectional view of a second embodiment of the hair iron of the present invention.
Figure 9:
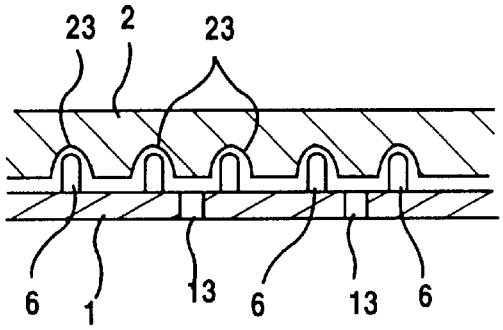
FIG. 9 is an enlarged partial cross-sectional view of the hair iron of FIG. 8 showing the hair curling body and the clip.
Figure 10:
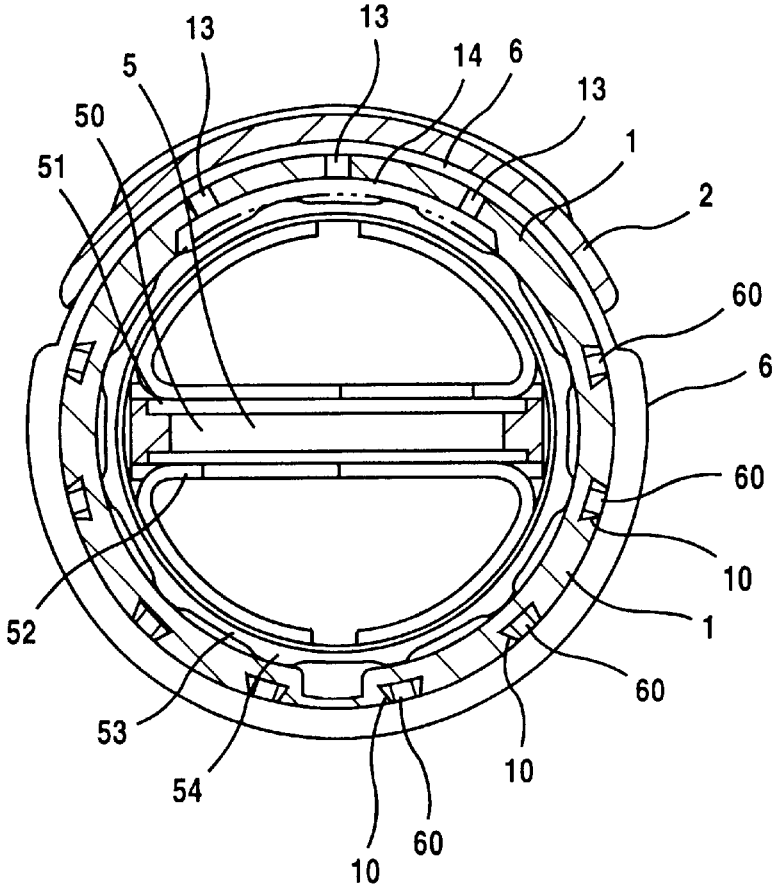
FIG. 10 is a cross-sectional view of the hair iron of FIG. 8.

The guards 6 may be provided to the entire circumferential area of the outer peripheral surface of the hair curling body 1 including an area facing the clip 2 in order to prevent fingers from coming into contact with this area. In this case, however, as shown in FIGS. 8–10, grooves 23 for fitting the guards 6 may preferably be formed on the inner surface of the clip in order to surely grip hairs. Further, because the existence of the clip 2 can prevent the user's skin from coming into contact with the hair curling body 1, the height H of the guards 6 not facing the clip 2 may preferably be set lower than that of the guards 6 facing the clip 2. Furthermore, where the height H of the guards 6 is of two different heights as described in the previous sentence, the portion of the hair curling body 1 between where the height of the guards changes, i.e., the height changed portion, may preferably be formed to be a smooth curve, as shown in FIG. 10.

Figure 12:
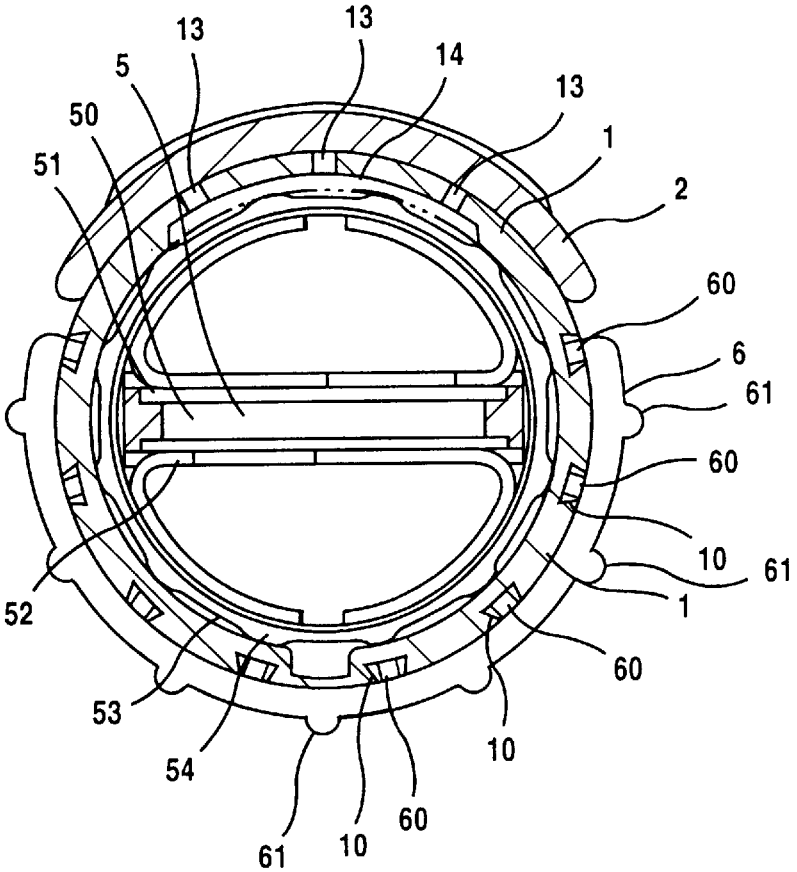
FIG. 12 is a cross-sectional view of a fourth embodiment of the hair iron of the present invention.

FIG. 12 shows that small protrusions 61 are formed on outer peripheral edges of the guards 6 at certain intervals. These small protrusions 61 can keep the distance between the user's skin and the outer peripheral surface of the hair curling body 1 large. Furthermore, the use of the small protrusions 61, as compared to raising the entire height H of the guards 6 discussed in the previous paragraph, allows the guards 6 to not cause any trouble when hairs are wound around the hair curling body 1 and/or detached from the hair curling body 1.

Figure 13:
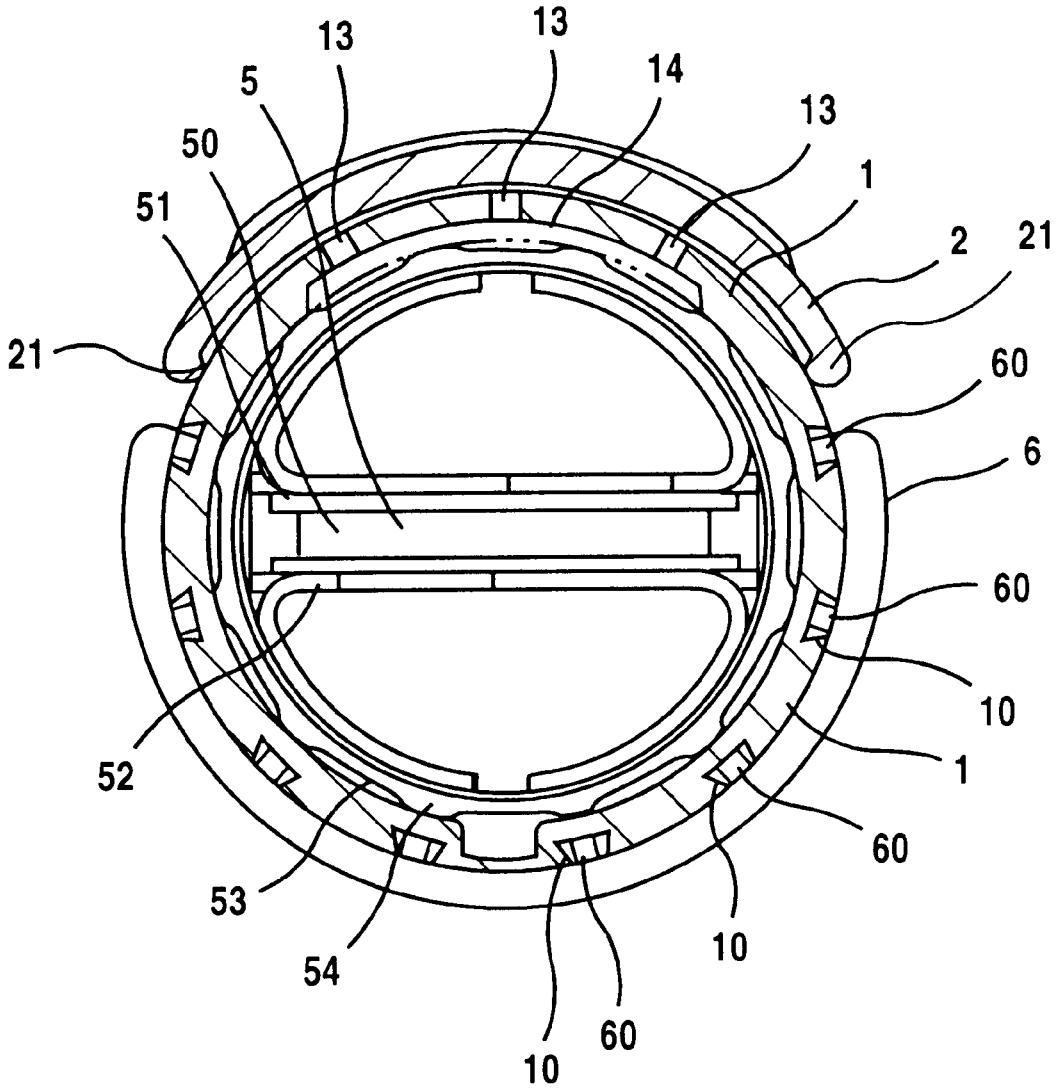
FIG. 13 is a cross-sectional view of a fifth embodiment of the hair iron of the present invention.
Figure 14:
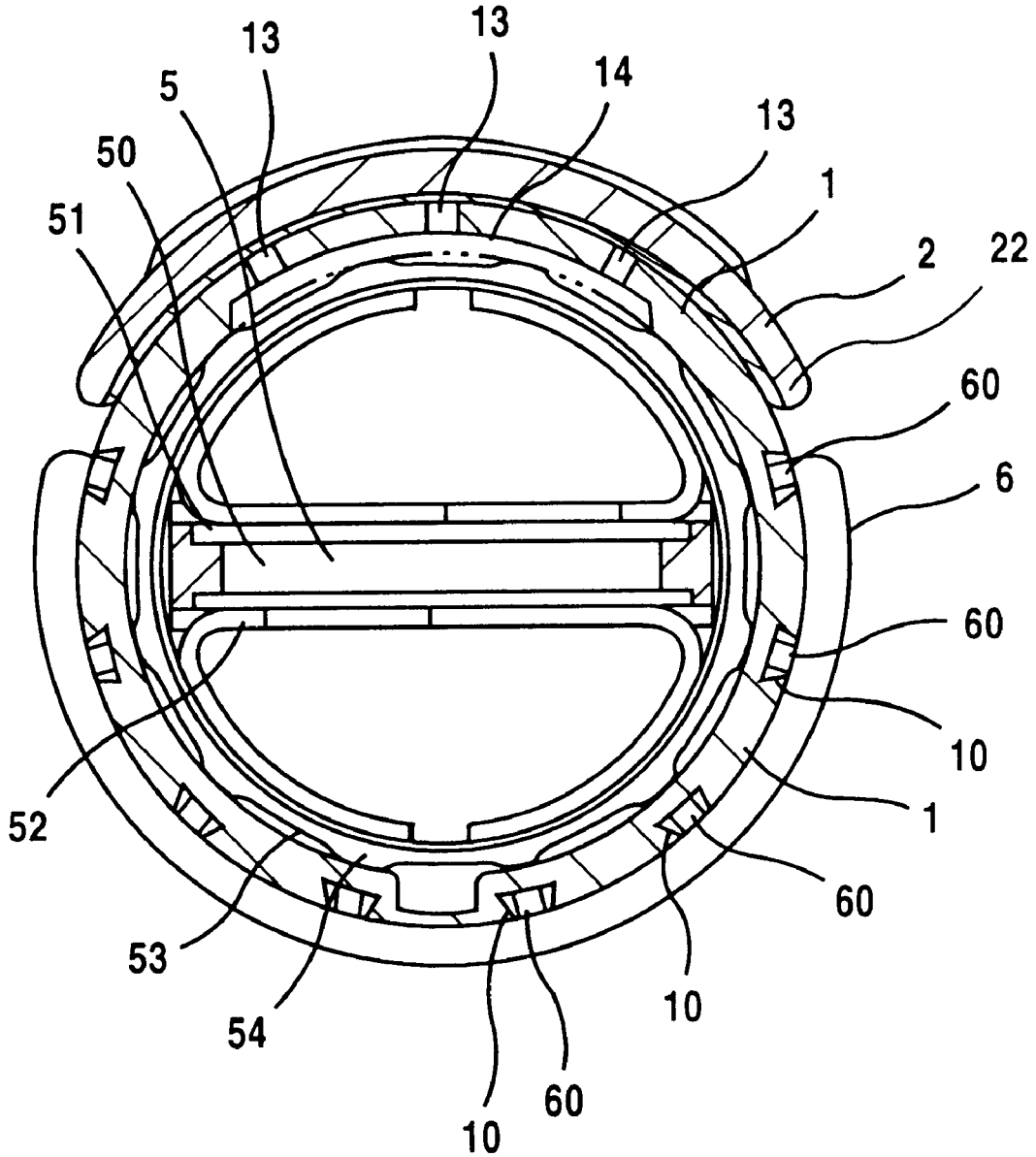
FIG. 14 is a cross-sectional view of a sixth embodiment of the hair iron of the present invention.

When heating hairs wound around the hair curling body 1, giving a certain tension to hairs is effective to curl the hairs, and holding the hairs by the clip 2 is necessary to give the tension. In order to give a certain tension while preventing slips of hairs, as shown in FIG. 13, protrusions 21 having high coefficient of friction, such as rubber, may preferably be formed on an inner surface of the clip 2 facing the hair curling body 1. Alternatively, as shown in FIG. 14, slip preventing materials 22 having high coefficient of friction may preferably be provided to the entire inner surface of the clip 2 facing the hair curling body 1.

Figure 15:
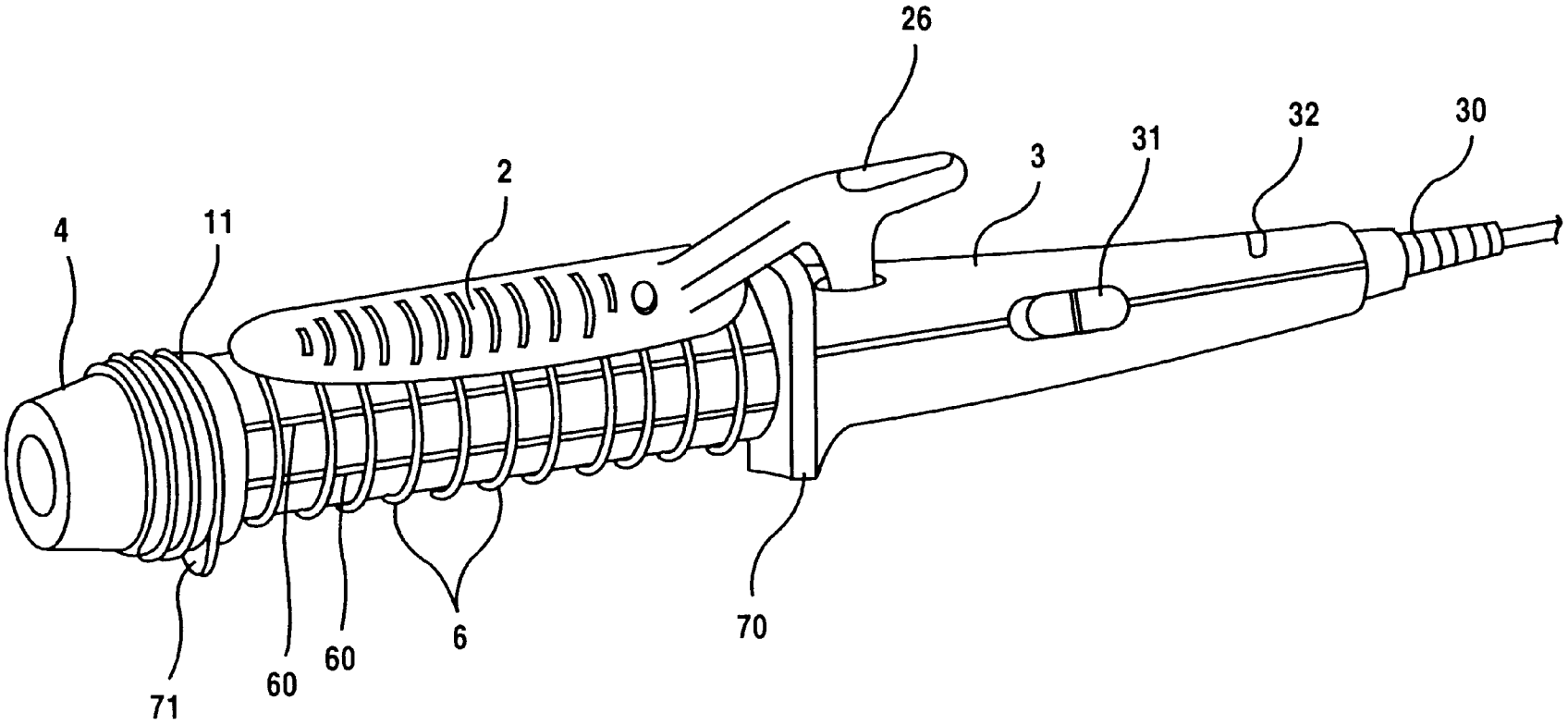
FIG. 15 is a perspective view of a seventh embodiment of the hair iron of the present invention.

In the case where the guards 6 are provided on the outer peripheral surface of the hair curling body 1, as shown in FIG. 15, if stands 70, 71, which prevent the guards 6 from coming in contact with a desk or other flat surface on which the hair iron is placed are made of low heat conductive materials, the effects of heat on the surface of the desk or other flat surface on which the hair iron is placed can be decreased. The height between the central axis of the hair curling body 1 and the stand 70 near the grip portion 3 may preferably be smaller than the height between the central axis of the hair curling body 1 and the stand 71 near the water tank 4 so that the hair curling body 1 is declined in the direction of the water tank 4 when the hair iron is placed on the desk or other flat surface. This prevents water which has leaked out of the water tank 4 from staying in the hair curling body 1 or grip portion 3.

In the embodiments mentioned above, even though the rib-shaped guards 6 extending in the circumferential direction of the hair curling body 1 are provided such that the guards 6 are perpendicular to the axis of the hair curling body 1, the guards 6 may be a helical rib-shaped member formed on the outer peripheral surface of the hair curling body 1 as shown in FIG. 15. The helical rib-shaped guards 6 are also provided with connecting rods 60 which are buried within the hair curling body 1 so as not to protrude from the outer peripheral surface of the hair curling body 1 as mentioned above.

Figure 16:
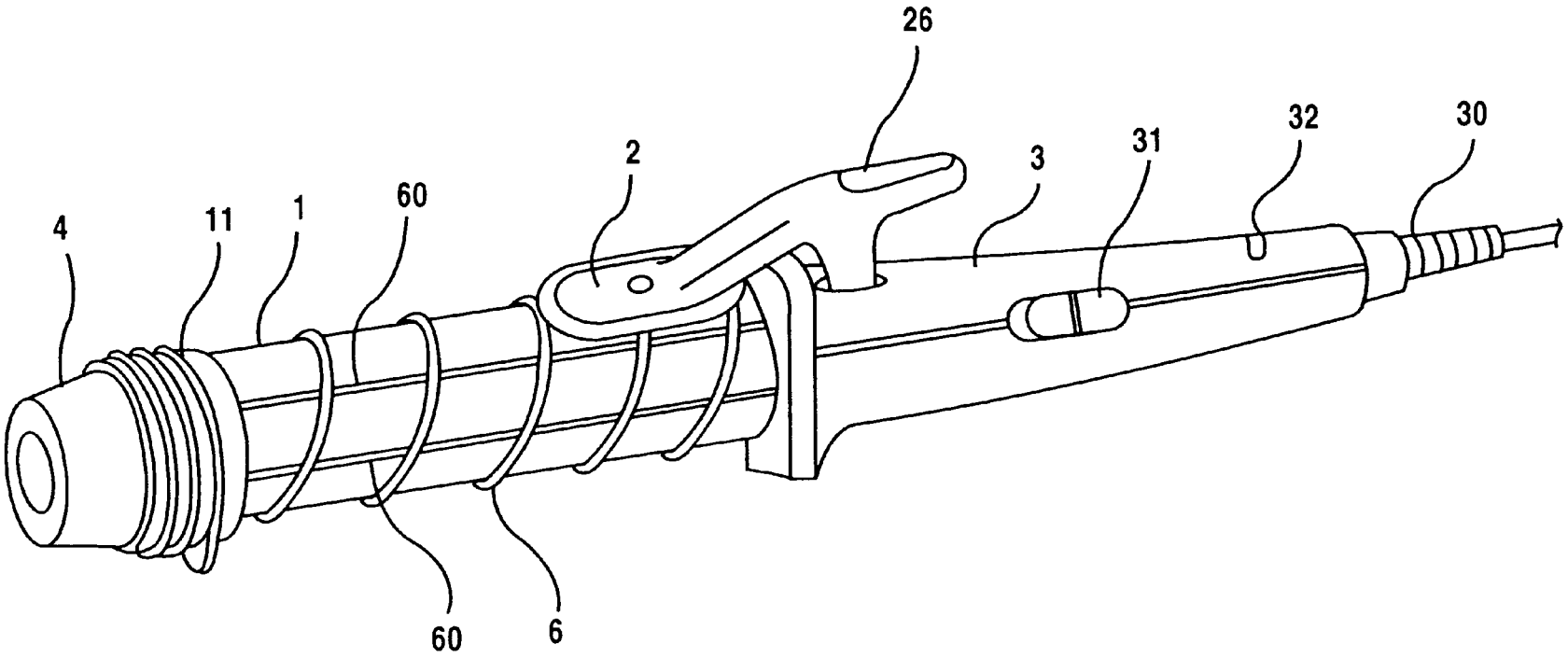
FIG. 16 is a perspective view of a eighth embodiment of the hair iron of the present invention.

A hair iron having the helical shaped guards 6 as above-mentioned can curl hairs into a curly hair style because hairs can be continuously wound around the hair curling body 1 several times without letting hairs cross the guards 6. Further, because the hairs which are continuously wound around the outer peripheral surface of the hair curling body 1 can be held by grasping the end portion of the hairs by means of the clip 2, the clip 2 may have a length shorter than the length of the hair curling body 1 as shown in FIG. 16. Shortening the length of the clip 2 makes it easy to continuously wind hairs around the outer peripheral surface of the hair curling body 1.

In the hair iron according to the present invention as mentioned above, a clip for holding hairs between the outer peripheral surface of the hair curling body and the inner surface of the clip is made of low heat conductive materials. Rib-shaped guards which extend in the circumferential direction of the hair curling body and made of low heat conductive materials are provided at least on an area of the outer peripheral surface of the hair curling body other than the area facing the clip. The guards keep a certain distance between the outer peripheral surface of the hair curling body and the user's skin. Therefore, the user's skin is prevented from coming into contact with the heated surface of the hair curling body. Thus, there is no fear that the user will feel excessive heat from the outer peripheral surface of the hair curling body of the hair iron or get burned. Further, because the guards are disposed at certain intervals in the axial direction of the hair curling body and are connected by connecting rods which are buried in the hair curling body such that upper surfaces of the guards are located at approximately the same level as or below the outer peripheral surface of the hair curling body, the connecting rods never cause hairs to be displaced from the outer peripheral surface of the hair curling body, never leave a mark on the hairs, and never causes the hairs to cling to the outer peripheral surface of the hair curling body. Thus, smooth and certain hair curling can be performed.

If each connecting rod is positioned in a dovetail groove formed in the outer peripheral surface of the hair curling body, the connecting rods need not be projected radially outwardly from the outer peripheral surface of the hair curling body, and the connecting rods and the guards are prevented from being knocked off the outer peripheral surface from which they radially outwardly project.

The guards may also be provided on an area facing the clip. This surely prevents the user's skin or fingers from coming into contact with the heated surface of the hair curling body to avoid getting burned.

If the guards have a height of about 2 mm, a width of about 1 mm, and are arranged on the hair curling body at intervals of 5–6 mm, contact between the user's skin and the outer peripheral surface of the hair curling body can be prevented. Further, these dimensions and spacing of the guards prevents a decrease in the surface area of the hair curling body due to the presence of the guards. Furthermore, a decrease in the heat efficiency of the hair iron for curling hairs can be avoided and the guards can have a certain strength.

Small protrusions may be provided to the outer peripheral edges of the guards. The small protrusions allow a certain distance between the user's skin and the outer peripheral surface of the hair curling body to be kept without causing any obstacles when the hairs are wound around the hair curling body and/or detached therefrom, as compared to when the entire height of the guards is raised. Thus, prevention of the user's skin from being burn is more certain, without causing deterioration in the of handling of the hair iron.

Where the guards are formed on the outer peripheral surface of the hair curling body to be of spiral-shape, hairs can be curled into a curly hair style because the hairs can be wound continuously.

In forming the guards to be of spiral-shape, if the length of the clip is limited to only a part of the entire length of the axial direction of the hair curling body, continuously winding hairs several times can easily be performed without losing the hair holding function of the clip.

In a case where the guards are only formed on an area of the hair curling body not facing the clip, if a certain space is formed between the edges of the guards and the lateral edges of the clip, hairs are prevented from clinging or pinching in a boundary portion between the guards and the clip to be curled unexpectedly.

In a guards are detachably attached to the hair curling body, the guards can be detached when unnecessary and exchanged for different kinds of guards.

If a hair slip preventing device is provided to an area of the hair curling body facing the clip, curling of hairs can be performed more surely, while giving the necessary tension to the hairs because the hairs wound around the hair curling body are surely held.

If the hair iron is provided with a stand which outwardly protrudes beyond the guards, the guards are prevented from being deformed by the weight of the hair iron or damaged by the heat of the hair curling body when the hair iron is placed on a desk or other flat surface.

The terms and expressions employed herein are used as terms of description and not of limitation, and there is no intent, in the use of such terms and expressions, of excluding any equivalents of the features shown and described or portions thereof, but it should be recognized that various modifications are possible within the scope of the invention claimed.

What is claimed is:

1. A hair iron, comprising:

a hair curling body having an outer peripheral surface on which hairs are wound;

a clip pivotally biased against said outer peripheral surface of said hair curling body for holding said hairs between said clip and said outer peripheral surface of said hair curling body, said clip being made of low heat conductive materials;

a heater for heating said hair curling body;

a plurality of rib-shaped guards extending in a circumferential direction of said hair curling body and disposed on at least an area of said outer peripheral surface of said hair curling body other than an area of said outer peripheral surface facing said clip, each guard of said plurality of rib-shaped guards being made of low heat conductive materials, wherein said plurality of rib-shaped guards are disposed at certain intervals in an axial direction of said hair curling body and are connected by connecting rods which are buried in said hair curling body such that upper surfaces of said connecting rods are positioned so as to be at a same level as or below said outer peripheral surface of said hair curling body; and steam holes for spouting steam provided in said area of said outer peripheral surface facing said clip, wherein each guard of said plurality of rib-shaped guards has an inner surface, said entire inner surface of each guard of said plurality of rib-shaped guards is fitted on and in contact with said outer peripheral surface of said hair curling body along the circumferential direction of said hair curling body.

2. The hair iron as recited in claim 1, wherein said connecting rods are disposed in a dovetail groove formed in said outer peripheral surface of said hair curling body.

3. The hair iron as recited in claim 1, wherein each guard of said plurality of guards is provided on said area facing said clip.

4. The hair iron as recited in claim 1, wherein each guard of said plurality of guards has a height of about 2 mm, a width of about 1 mm and is arranged on said hair curling body at spaced intervals of about 5 to 6 mm.

5. The hair iron as recited in claim 1, wherein each guard of said plurality of guards has small protrusions on outer peripheral edges thereof.

6. The hair iron as recited in claim 1, wherein each guard of said plurality of guards is spiral-shaped and is formed on said outer peripheral surface of said hair curling body.

7. The hair iron as recited in claim 6, wherein said clip has a length facing a part of an axial direction of said hair curling body.

8. The hair iron as recited in claim 1, wherein each guard of said plurality of guards is only formed on an area of said hair curling body not facing said clip, and a certain space is formed between an edge of each guard of said plurality of guards and an lateral edge of said clip.

9. The hair iron as recited in claim 1, wherein each guard of said plurality of guards is detachably attached to said hair curling body.

10. The hair iron as recited in claim 1, wherein said clip is provided with a slip preventing device at said area of said clip facing to said hair curling body.

11. The hair iron as recited in claim 1, further comprising a stand outwardly protruding beyond each guard of said plurality of guards.

* * * * *